US010969739B2

(12) United States Patent
Park et al.

(10) Patent No.: US 10,969,739 B2
(45) Date of Patent: Apr. 6, 2021

(54) DEVELOPING DEVICE HAVING AIR OUTLET

(71) Applicant: HEWLETT-PACKARD DEVELOPMENT COMPANY, L.P., Spring, TX (US)

(72) Inventors: Jong Hyun Park, Suwon (KR); Mitsuru Oikawa, Suwon (KR); Jong Hwa Park, Suwon (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/608,888

(22) PCT Filed: Feb. 27, 2018

(86) PCT No.: PCT/KR2018/002380

§ 371 (c)(1),
(2) Date: Oct. 28, 2019

(87) PCT Pub. No.: WO2019/013421

PCT Pub. Date: Jan. 17, 2019

(65) Prior Publication Data

US 2020/0183325 A1 Jun. 11, 2020

(30) Foreign Application Priority Data

Jul. 11, 2017 (KR) ..... 10-2017-0087777

(51) Int. Cl.

| | |
|---|---|
| ***G03G 21/20*** | (2006.01) |
| ***G03G 15/08*** | (2006.01) |
| ***G03G 21/00*** | (2006.01) |

(52) U.S. Cl.
CPC ..... *G03G 21/206* (2013.01); *G03G 15/0808* (2013.01); *G03G 21/0005* (2013.01)

(58) Field of Classification Search
CPC ..... G03G 15/0121; G03G 15/0898; G03G 21/206
See application file for complete search history.

(56) References Cited

U.S. PATENT DOCUMENTS

| | | | |
|---|---|---|---|
| 2009/0245849 | A1 | 10/2009 | Nakashima |
| 2015/0016848 | A1 | 1/2015 | Ishii et al. |
| 2015/0093139 | A1 | 4/2015 | Kuramoto et al. |

FOREIGN PATENT DOCUMENTS

| | | |
|---|---|---|
| JP | 2005352076 | 12/2005 |
| JP | 2007226114 | 9/2007 |

(Continued)

*Primary Examiner* — Walter L Lindsay, Jr.
*Assistant Examiner* — Andrew V Do
(74) *Attorney, Agent, or Firm* — Trop Pruner & Hu, P.C.

(57) ABSTRACT

A developing device including a developing roller mounted in a developing chamber is provided. In the developing device, the developing roller is partially exposed to an environment outside the developing chamber through an opening portion of the developing chamber, an air inlet is provided between an upstream boundary of the opening portion in a rotational direction of the developing roller and an outercircumference of the developing roller, wherein air may pass into the developing chamber through the air inlet, and an air outlet may be formed near the upstream boundary of the opening portion and communicatively connected to the developing chamber so as to discharge the air in the developing chamber. The air outlet is located outside an effective image area in a length direction of the developing roller.

20 Claims, 8 Drawing Sheets

(56) References Cited

FOREIGN PATENT DOCUMENTS

| | | |
|---|---|---|
| JP | 2010134327 | 6/2010 |
| JP | 2014224893 | 12/2014 |
| JP | 2017116666 | 6/2017 |

[Fig. 1]
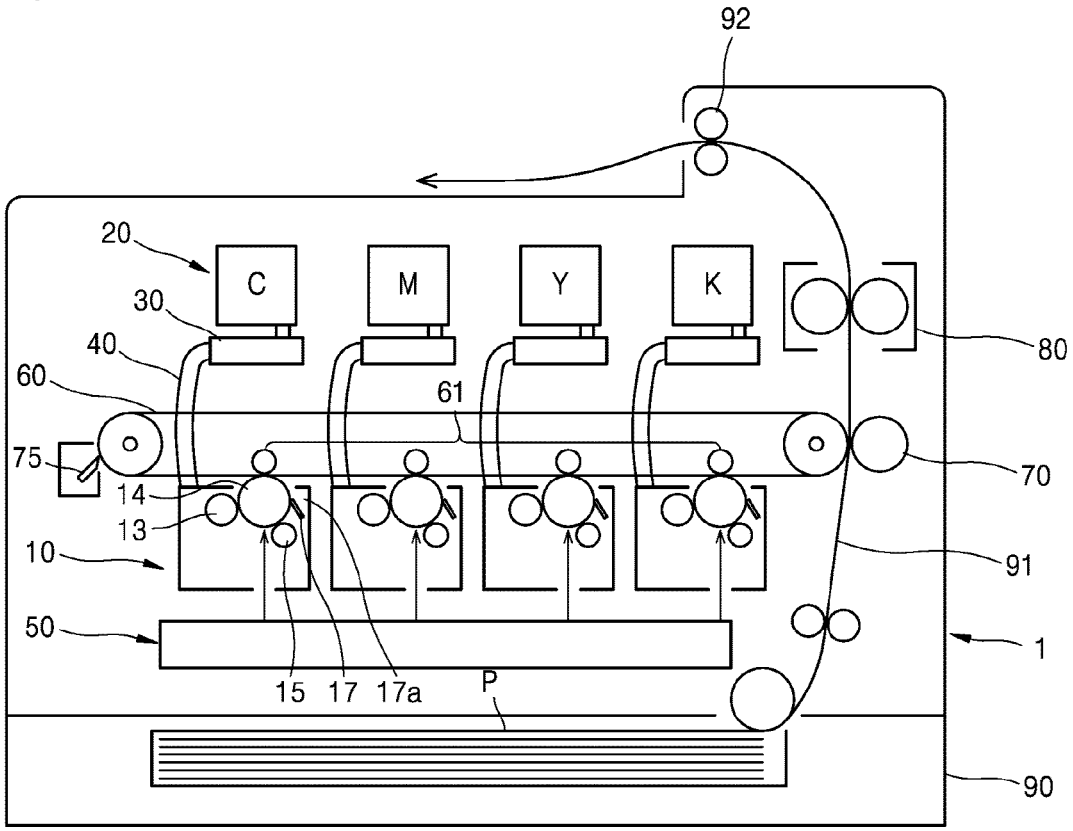
[Fig. 2]
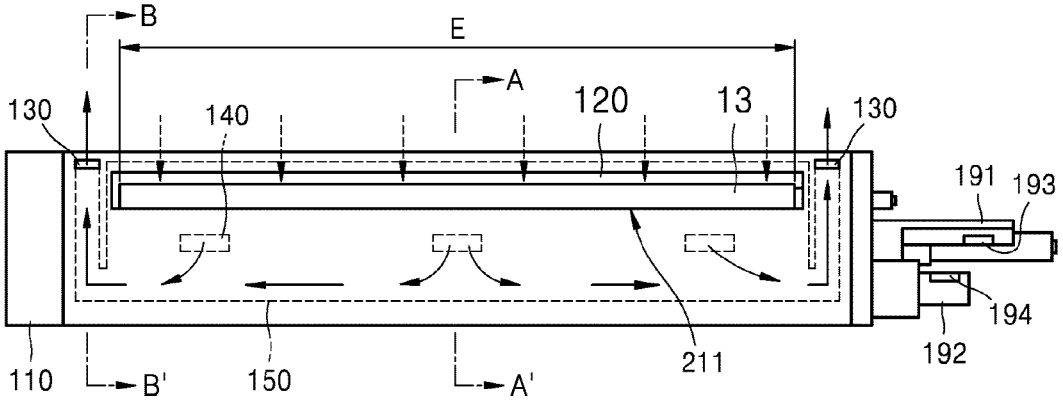

[Fig. 3]
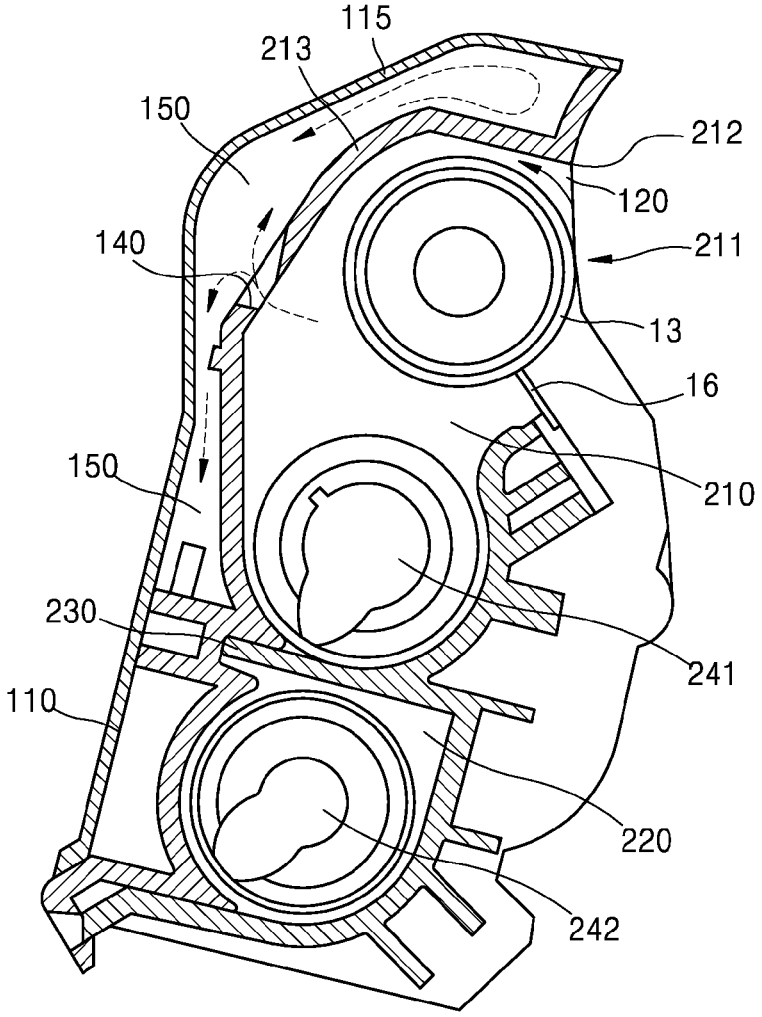

[Fig. 4]
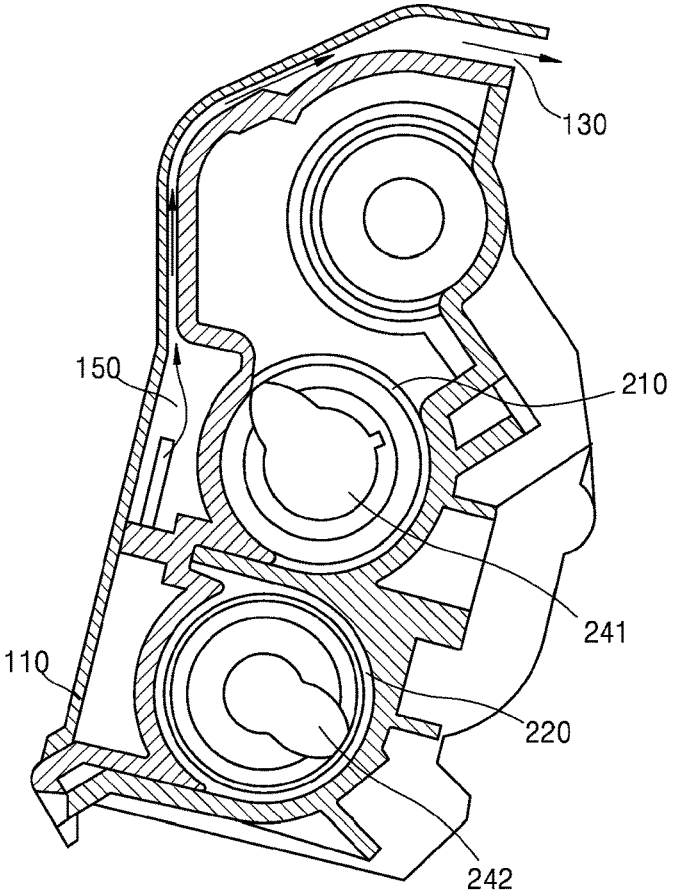
[Fig. 5a]
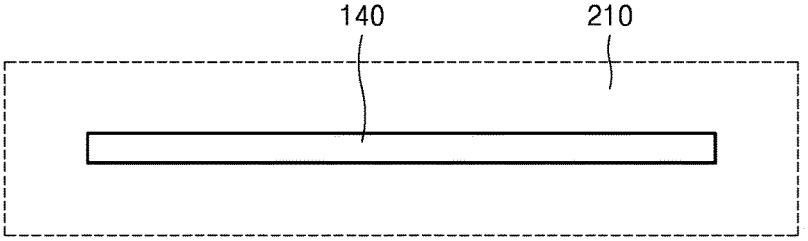
[Fig. 5b]
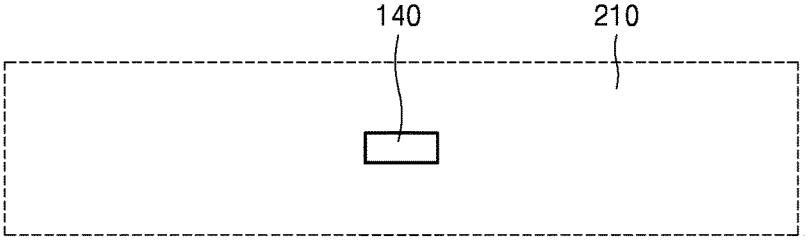
[Fig. 5c]
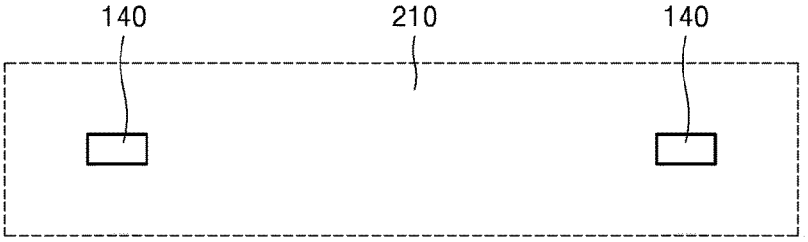

[Fig. 5d]
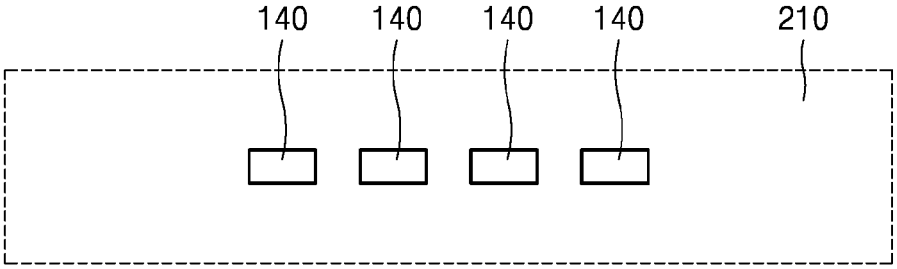
[Fig. 6]
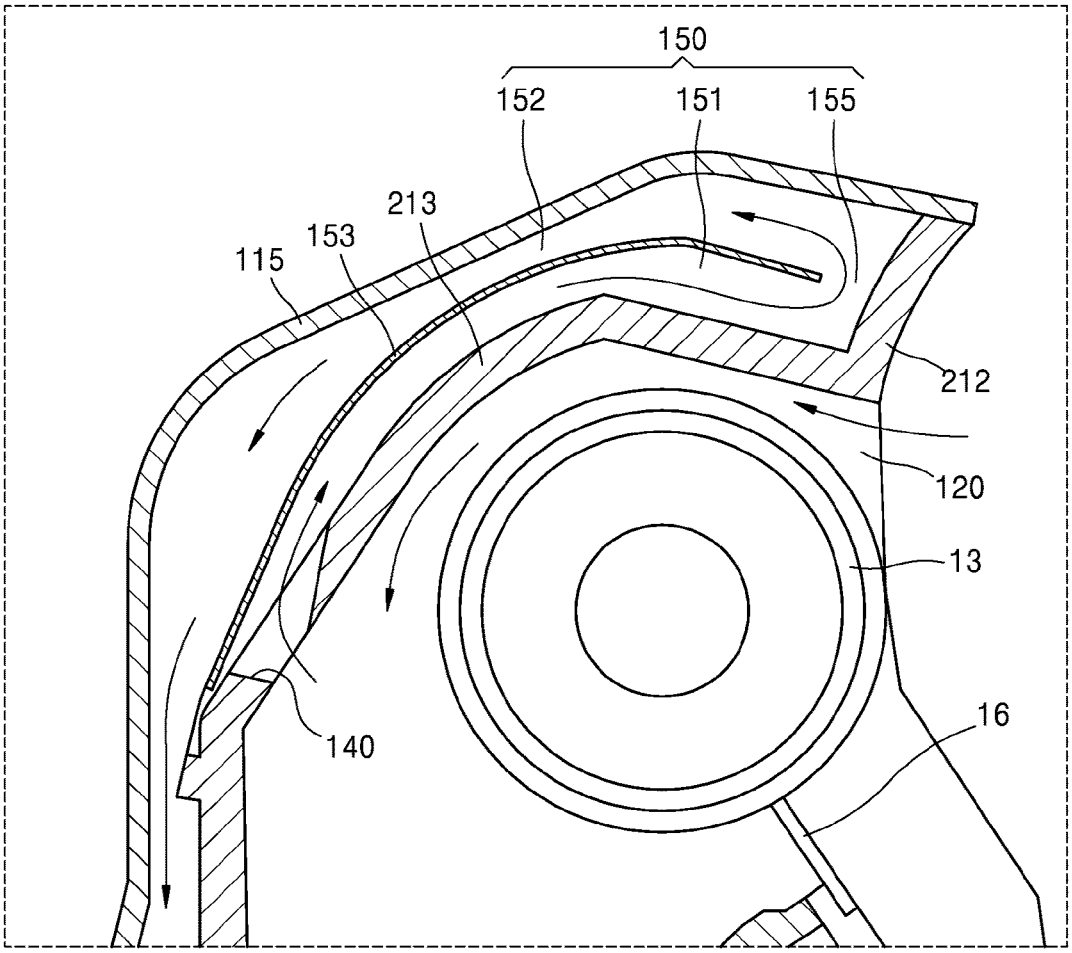

[Fig. 7]
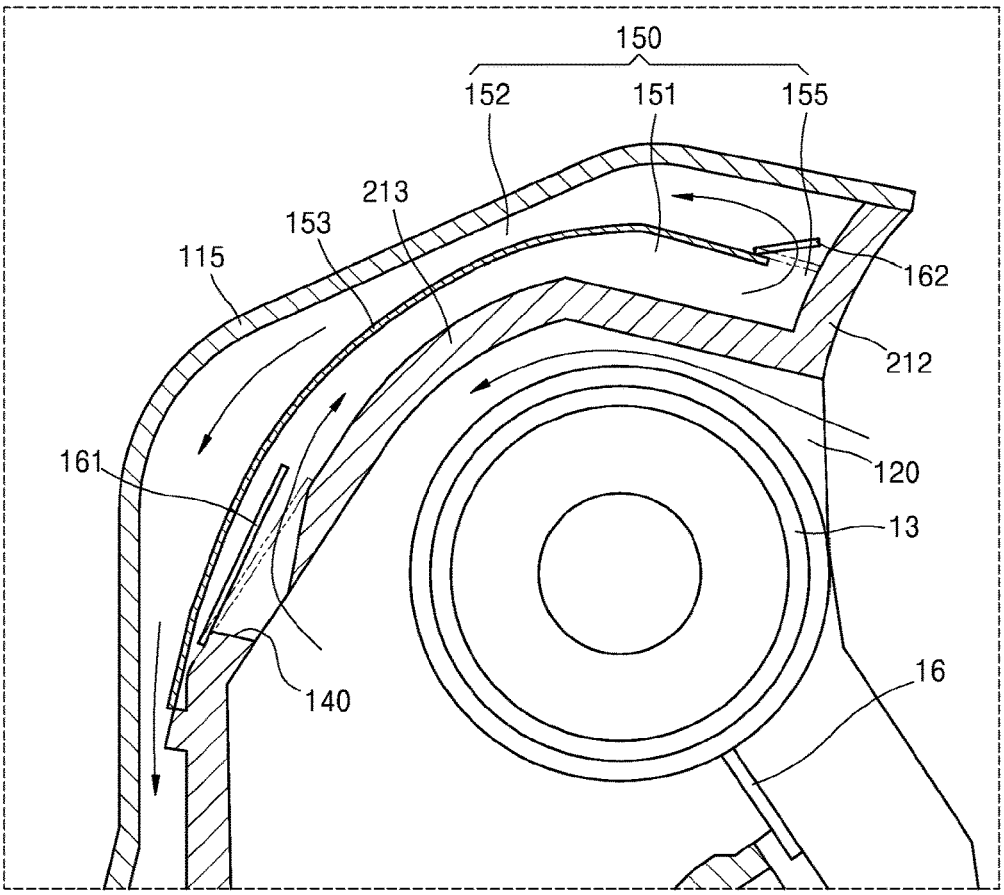
[Fig. 8]
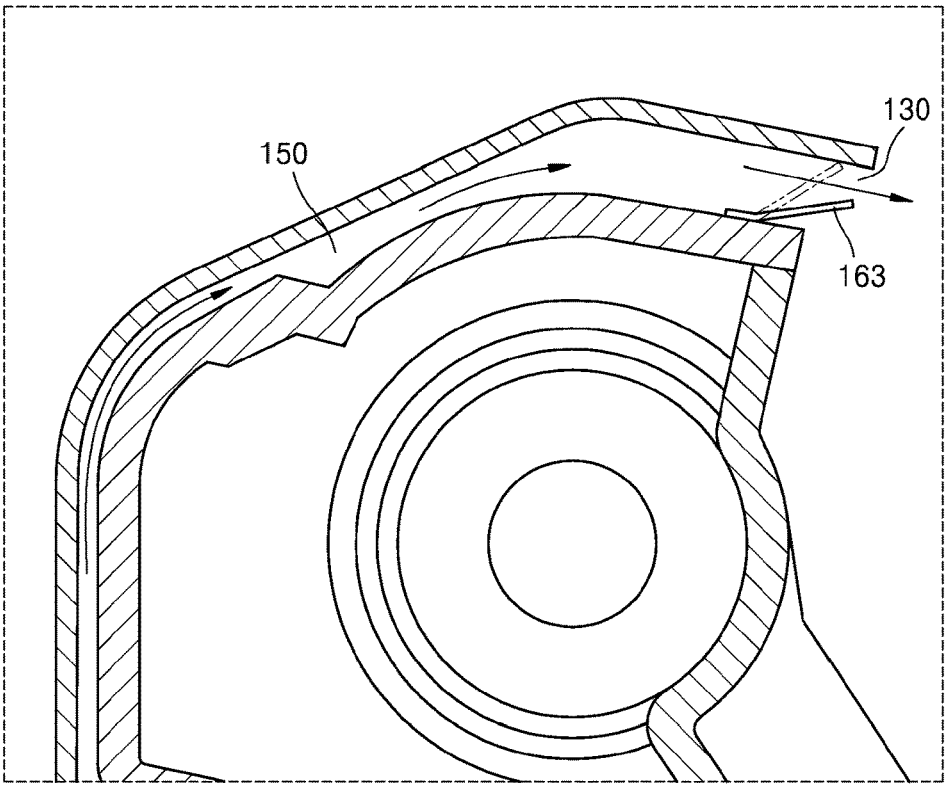

[Fig. 9]
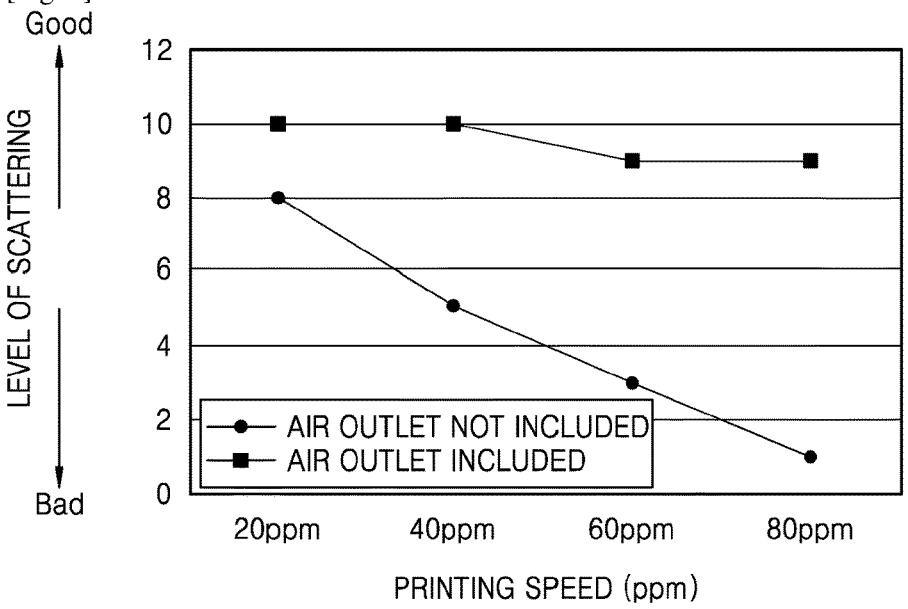
[Fig. 10]
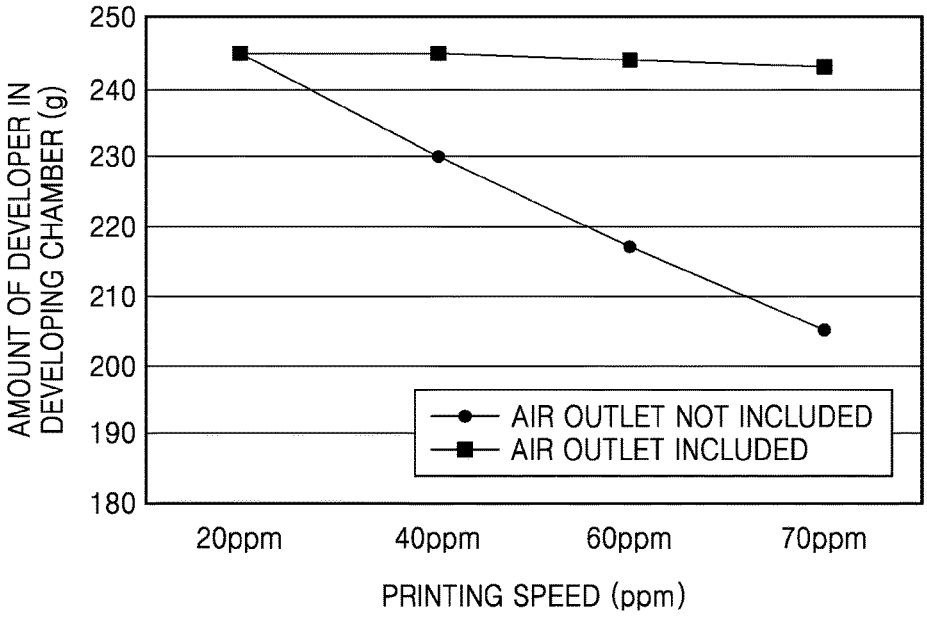
[Fig. 11a]
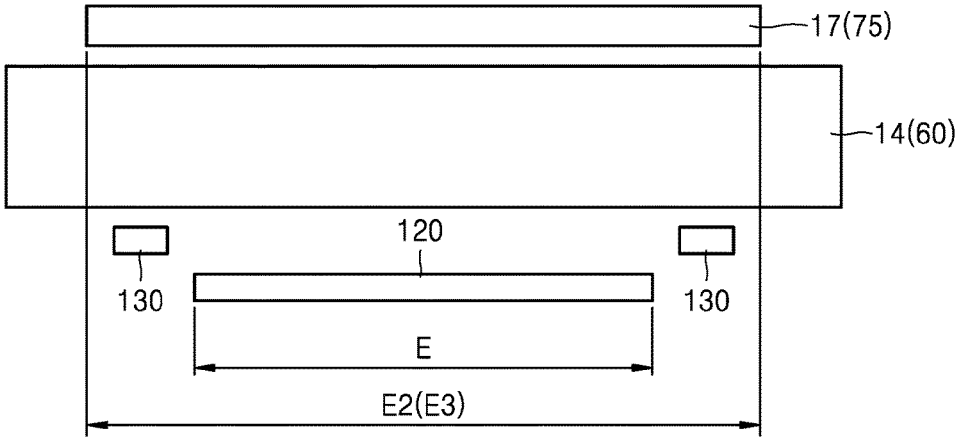

[Fig. 11b]
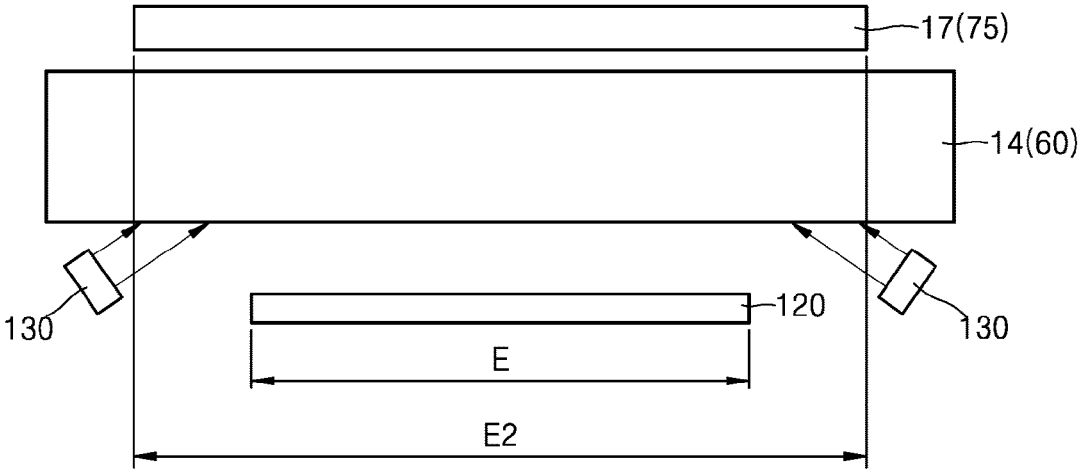
[Fig. 11c]
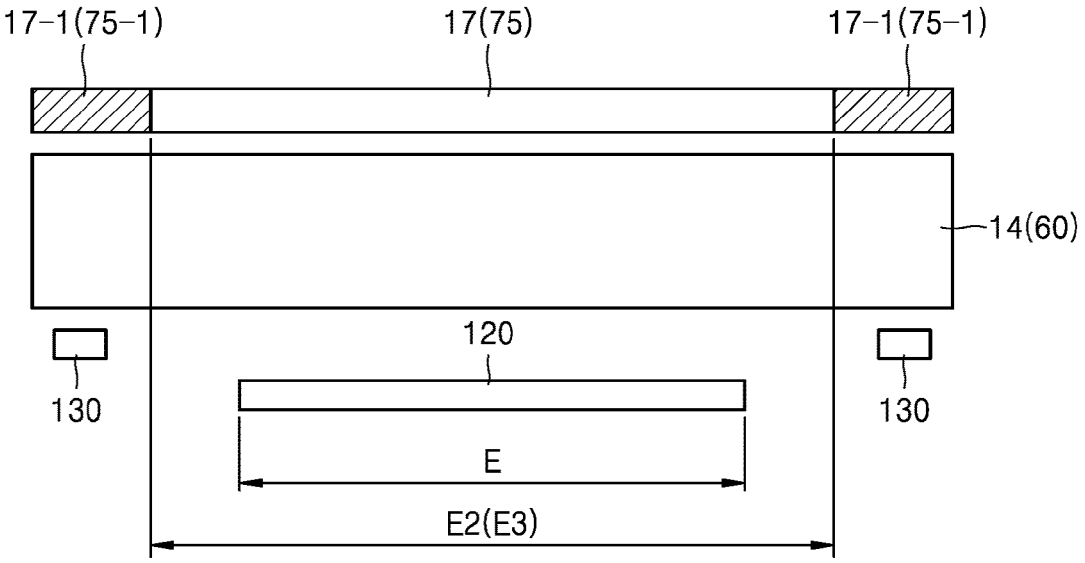

[Fig. 12]
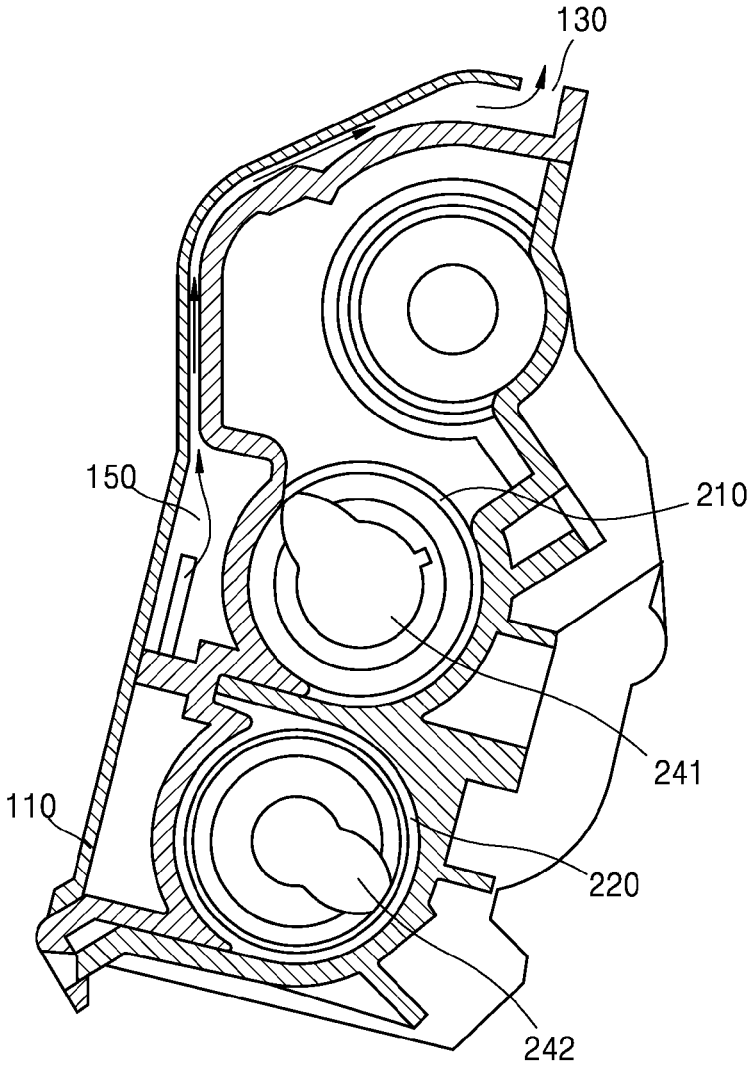

DEVELOPING DEVICE HAVING AIR OUTLET

BACKGROUND ART

An image forming apparatus using an electrophotographic method supplies toner to an electrostatic latent image formed on a photosensitive body to form a toner image, transfers the toner image onto a recording medium, and fixes the transferred toner image on the recording medium so as to print an image on the recording medium. A developing device accommodates toner, and supplies the toner to the electrostatic latent image formed on the photosensitive body to form a visible toner image on the photosensitive body.

A developing device includes a developing chamber and a developing roller supplying toner, accommodated in the developing chamber, to a photosensitive body. As the developing roller is rotated, air flows into the developing chamber which increases a pressure therein. When an internal pressure in the developing chamber has reached a predetermined level, the air reflows into an air inlet, causing the air to be discharged to the outside through the air inlet. In such a case, the toner in the developing chamber may also be discharged with the air, which may result in scattering of the toner to the outside of the developing device. The scattered toner may contaminate the photosensitive body and degrade a printing image quality. In addition, the scattered toner may contaminate an inner portion of an image forming apparatus.

BRIEF DESCRIPTION OF DRAWINGS

These and/or other aspects will become apparent and more readily appreciated from the following description of the examples, taken in conjunction with the accompanying drawings in which:

FIG. 1 is a schematic structural view of an electrophotographic image forming apparatus according to an example;

FIG. 2 is a left side view of a portion of a developing device illustrated in FIG. 1, in which a developing roller is mounted, according to an example;

FIG. 3 is a cross-sectional view of the developing device of FIG. 2 taken along line A-A', according to an example;

FIG. 4 is a cross-sectional view of the developing device of FIG. 2 taken along line B-B', according to an example;

FIGS. 5*a* through 5*d* illustrate a shape of a flue hole according to examples;

FIG. 6 illustrates a cross-sectional view of FIG. 2 taken along a line A-A', illustrating a discharge path according to an example;

FIG. 7 is a cross-sectional view of a developing device including a discharge path having a valve, according to an example;

FIG. 8 is a cross-sectional view of a developing device including an air outlet having a valve, according to an example;

FIG. 9 is a graph showing a result of determining a level of scattering of a developer according to a printing speed, according to an example;

FIG. 10 is a graph showing a result of determining an amount of a developer in a developing chamber according to a printing speed, according to an example;

FIGS. 11*a* through 11*c* are schematic views of an installation location of an air outlet according to an example; and FIG. 12 is a cross-sectional view of a developing device according to an example.

MODE FOR THE INVENTION

Reference will now be made to examples, which are illustrated in the accompanying drawings, wherein like reference numerals refer to like elements throughout. In this regard, the present examples may have different forms and should not be construed as being limited to the descriptions set forth herein. Accordingly, the examples are merely described below, by referring to the figures, to explain aspects. As used herein, the term "and/or" includes any and all combinations of one or more of the associated listed items. Expressions such as "at least one of," when preceding a list of elements, modify the entire list of elements and do not modify the individual elements of the list.

Hereinafter, a developing device and an electrophotographic image forming apparatus including the developing device will be described with regard to examples of the invention with reference to the attached drawings. In the present specification and drawings, elements having substantially the same functions will be labeled with like reference numerals to avoid repeated description.

FIG. 1 is a schematic structural view of an electrophotographic image forming apparatus according to an example. The electrophotographic image forming apparatus according to the present example prints a color image by using an electrophotographic method. In other words, the image forming apparatus according to the present example is a color image forming apparatus.

Referring to FIG. 1, the image forming apparatus includes a plurality of developing devices 10, an exposure device 50, a transfer device, and a fixing device 80.

The image forming apparatus may further include a plurality of developer cartridges 20 accommodating a developer. The plurality of developer cartridges 20 are respectively connected to the plurality of developing devices 10, and the developer accommodated in the plurality of developer cartridges 20 is supplied to each of the developing devices 10. The plurality of developer cartridges 20 and the plurality of developing devices 10 are attachable to and detachable from a main body 1 and are individually replaceable.

The plurality of developing devices 10 may include a plurality of developing devices 10C, 10M, 10Y, and 10K that are used to form toner images of cyan (C), magenta (M), yellow (Y), and black (K) colors, respectively. In addition, the plurality of developer cartridges 20 may include a plurality of developer cartridges 20C, 20M, 20Y, and 20K respectively accommodating developers of cyan (C), magenta (M), yellow (Y), and black (K) colors to be supplied to the plurality of developing devices 10C, 10M, 10Y, and 10K. However, the scope of the present disclosure is not limited thereto, and developer cartridges 20 and developing devices 10 may be further included to accommodate and develop developers of other various colors such as light magenta or white in addition to the above-described colors. Hereinafter, an example of an image forming apparatus including the plurality of developing devices 10C, 10M, 10Y, and 10K and the plurality of developer cartridges 20C, 20M, 20Y, and 20K will be described, and unless otherwise described, elements labeled C, M, Y, or K below respectively refer to elements for developing developers of cyan (C), magenta (M), yellow (Y), and black (K) colors.

The developing devices 10 may each include a photosensitive drum 14, on a surface of which an electrostatic latent image is formed, and a developing roller 13 supplying a developer to the electrostatic latent image to develop the electrostatic latent image into a visible toner image. The photosensitive drum 14 is an example of a photosensitive body, on a surface of which an electrostatic latent image is formed, and may include a conductive metal pipe and a photosensitive layer formed on an outer circumference thereof. A charging roller 15 is an example of a charging device for charging the photosensitive drum 14 to have a uniform surface potential. Instead of the charging roller 15, a charging brush, a corona charging device, or the like may also be used.

Although not illustrated in FIG. 1, the developing devices 10 may further include a charging roller cleaner for removing foreign substances such as a developer or dust adhered to the charging roller 15, a cleaning member 17 for removing a developer remaining on a surface of the photosensitive drum 14 after an intermediate transfer process to be described later, and a regulation member for regulating an amount of a developer supplied to a developing region in which the photosensitive drum 14 and the developing roller 13 face each other. Waste developer is accommodated in a waste developer accommodating unit 17*a*. The cleaning member 17 may be, for example, a cleaning blade that contacts a surface of the photosensitive drum 14 to scrape the developer. Although not illustrated in FIG. 1, the cleaning member 17 may be a cleaning brush that rotates to contact a surface of the photosensitive drum 14 and scrape the developer.

When a mono-component developing method is used, a developer accommodated in the developer cartridges 20 may be toner. The developing roller 13 may be rotated in contact with the photosensitive drum 14. Also, the developing roller 13 may rotate in a state where the developing roller 13 is spaced apart from the photosensitive drum 14 by a distance of about several tens to about several hundreds of microns.

When a dual-component developing method is used, a developer accommodated in the developer cartridges 20 may be toner. When a trickle method is used as a developing method, a carrier and a toner may be accommodated in the developer cartridge 20 as a developer. Hereinafter, an example of the developing device 10 in which a dual-component developing method is used will be described.

A developer accommodated in the developer cartridge 20 is supplied to the developing device 10. The developing roller 13 is spaced apart from the photosensitive drum 14. A distance between an outer circumferential surface of the developing roller 13 and an outer circumferential surface of the photosensitive drum 14 may be, for example, about several tens to about several hundreds of microns. The developing roller 13 may be a magnetic roller. In addition, the developing roller 13 may have a form in which a magnet is disposed in a rotating developing sleeve. In the developing device 10, toner is mixed with a carrier, and the toner adheres to a surface of a magnetic carrier. The magnetic carrier adheres to a surface of the developing roller 13 and is transported to the developing region in which the photosensitive drum 14 and the developing roller 13 face each other. A regulating member (not shown) regulates an amount of the developer transported to the developing region. Via a developing bias voltage applied between the developing roller 13 and the photosensitive drum 14, only a necessary amount of the toner is supplied to the photosensitive drum 14 so as to develop an electrostatic latent image formed on a surface of the photosensitive drum 14 into a visible toner image.

When a trickle developing method is used, in order to maintain a uniform amount of developer in the developing device 10, residual carriers may be discharged out of the developing device 10 together with the toner through a trickle discharge outlet.

The exposure device 50 radiates light modulated according to image information, onto the photosensitive drum 14, to thereby form an electrostatic latent image on the photosensitive drum 14. Examples of the exposure device 50 may be a laser scanning unit (LSU) using a laser diode as a light source, a light-emitting diode (LED) exposure device that uses an LED as a light source, or the like.

The transfer device transfers the toner image formed on the photosensitive drum 14 onto a recording medium P. In the present example, a transfer device that uses an intermediate transfer method is used. For example, the transfer device may include an intermediate transfer belt 60, a plurality of intermediate transfer rollers 61, and a transfer roller 70.

The intermediate transfer belt 60 temporarily accommodates the toner image developed on the photosensitive drum 14 of the plurality of developing devices 10C, 10M, 10Y, and 10K. The plurality of intermediate transfer rollers 61 are disposed to face the photosensitive drum 14 of the plurality of developing devices 10C, 10M, 10Y, and 10K, with the intermediate transfer belt 60 therebetween. An intermediate transfer bias used to intermediately transfer the toner image developed on the photosensitive drum 14, to the intermediate transfer belt 60, is applied to the plurality of intermediate transfer rollers 61. Instead of the intermediate transfer rollers 61, a corona transfer device, a pin scorotron transfer device, or the like may be used.

The transfer roller 70 is disposed to face the intermediate transfer belt 60. A transfer bias for transferring the toner image transferred to the intermediate transfer belt 60, to the recording medium P, is applied to the transfer roller 70.

In addition, a cleaning member 75 that removes the developer remaining on a surface of the intermediate transfer belt 60 after the toner image is transferred to the recording medium P may be included. The cleaning member 75 may be, for example, a cleaning blade that contacts a surface of the intermediate transfer belt 60 to scrape the developer. Although not illustrated in FIG. 1, the cleaning member 75 may be a cleaning brush that rotates to contact the surface of the intermediate transfer belt 60 and scrape the developer.

The fixing device 80 fixes the toner image transferred to the recording medium P, on the recording medium P by applying heat and/or pressure to the toner image. The form of the fixing device 80 is not limited to that illustrated in FIG. 1.

According to the above-described configuration, the exposure device 50 irradiates light modulated according to image information of the colors onto the photosensitive drum 14 of the plurality of developing devices 10C, 10M, 10Y, and 10K to form an electrostatic latent image on the photosensitive drum 14. The electrostatic latent image of the photosensitive drum 14 of the plurality of developing devices 10C, 10M, 10Y, and 10K is developed into a visible toner image by using the C, M, Y, and K developers supplied from the plurality of developer cartridges 20C, 20M, 20Y, and 20K to the plurality of developing devices 10C, 10M, 10Y, and 10K. The developed toner images are sequentially intermediately transferred to the intermediate transfer belt 60. The recording medium P loaded in a feeding unit 90 is transported along a feeding path 91 between the transfer roller 70 and the intermediate transfer belt 60. Due to a transfer bias voltage applied to the transfer roller 70, the toner images that are intermediately transferred onto the intermediate transfer belt 60 are transferred to the recording medium P. When the recording medium P passes through the fixing device 80, the toner images are fixed to the recording medium P by heat and pressure. The recording medium P, with which fixing is completed, is discharged using a discharge roller 92.

The developer accommodated in the developer cartridge 20 is supplied to the developing device 10. When a quantity of the developer accommodated in the developer cartridge 20 is less than a certain amount, the developer cartridge 20 may be replaced with a new developer cartridge 20, or new developer may be filled in the developer cartridge 20.

The image forming apparatus may further include a developer supply unit 30. The developer supply unit 30 receives a developer from the developer cartridge 20 and supplies the same to the developing device 10. The developer supply unit 30 is connected to the developing device 10 via a supply pipe line 40. Although not illustrated in FIG. 1, the developer supply unit 30 may be omitted, and the supply pipe line 40 may directly connect the developer cartridge 20 and the developing device 10.

FIG. 2 is a left side view of a portion of a developing device illustrated in FIG. 1, in which a developing roller is mounted, according to an example. FIG. 3 is a cross-sectional view of the developing device of FIG. 2 taken along line A-A', according to an example. FIG. 4 is a cross-sectional view of the developing device of FIG. 2 taken along line B-B', according to an example.

Referring to FIGS. 2 through 4, the developing device 10 includes a developing casing 110 and the developing roller 13 is rotatably supported by the developing casing 110. The developing casing 110 accommodates a developer. As described above, the developer may be supplied from the developer cartridge 20.

A developing chamber 210 may be included in the developing casing 110. An opening portion 211, opened toward the photosensitive drum 14, is included in the developing chamber 210. The developing roller 13 is mounted in the developing chamber 210. The developing roller 13 is partially exposed to the outside of the developing chamber 210 through the opening portion 211, and an exposed portion of the developing roller 13 faces the photosensitive drum 14. The developing roller 13 supplies a toner accommodated in the developing chamber 210 to an electrostatic latent image formed on the photosensitive drum 14, through the opening portion 211, so as to develop the electrostatic latent image into a toner image.

The developing device 10, according to the present example that uses a dual-component developer, may further include an agitating chamber 220. The agitating chamber 220 is separated from the developing chamber 210 via a barrier wall 230. First and second agitating members 241 and 242 may be respectively included in the developing chamber 210 and the agitating chamber 220. The first and second agitating members 241 and 242 transport a developer in each of the developing chamber 210 and the agitating chamber 220 in a length direction of the developing roller 13, thereby agitating the toner and the carrier. The first and second agitating members 241 and 242 may be, for example, augers. The first and second agitating members 241 and 242 transport the developer in opposite directions to each other. For example, the first and second agitating members 241 and 242 may respectively transport the developer in a first direction and a second direction. An opening portion (not shown) is formed at each of two end portions of the barrier wall 230 in a length direction to thereby communicatively connect the developing chamber 210 and the agitating chamber 220. Accordingly, the developer in the developing chamber 210 is transported in the first direction by using the first agitating member 241. The developer is transported to the agitating chamber 220 through a first opening portion (not shown) formed at an end portion of the barrier wall 230 in the first direction. The developer in the agitating chamber 220 is transported in the second direction by using the second agitating member 242. The developer is transported to the developing chamber 210 through a second opening portion (not shown) formed at an end portion of the barrier wall 230 in the second direction. According to this configuration, the developer is circulated through a circulation passage sequentially including the developing chamber 210, the first opening portion, the agitating chamber 220, the second opening portion, and the developing chamber 210 again. A portion of the developer transported in the first direction in the developing chamber 210 adheres to the developing roller 13 so as to be supplied to the photosensitive drum 14.

An air inlet 120 is formed between an upstream boundary 212 of the opening portion 211 and an outer circumference of the developing roller 13 with respect to a rotational direction of the developing roller 13 (the rotational direction of the developing roller is generally indicated by the arrow near reference numeral 120). As a regulating member 16 is mounted at a downstream boundary of the opening portion 211 with respect to the rotational direction of the developing roller 13, the developing chamber 210 is communicatively connected to the outside through the air inlet 120. When the developing roller 13 is rotated, air flows from the outside of the developing device 10 into the developing chamber 210 through the air inlet 120.

The higher a printing speed of the image forming apparatus, the faster a rotational speed of the developing roller 13, and a speed and an amount of the air inflow are increased. Accordingly, the air pressure in the developing chamber 210 is raised. When the air pressure in the developing chamber 210 is saturated (or reaches a predetermined level), the air may be discharged through the air inlet 120. In this case, the developer may also be discharged with the air. Such a discharge of the developer may contaminate the photosensitive drum 14 and the inner portion of the image forming apparatus.

The developing device 10 according to the present example includes an air outlet 130 that is communicatively connected to the developing chamber 210 so as to reduce or prevent an excessive increase in the air pressure in the developing chamber 210. The air outlet 130 may be formed near the upstream boundary 212 of the opening portion 211. The air outlet 130 may be located above the opening portion 211 with respect to a gravitational direction. For example, the air outlet 130 may be located above the upstream boundary 212 of the opening portion 211 with respect to a gravitational direction.

As the air discharged from the air outlet 130 may contain the developer, the air outlet 130 may be provided in an outer portion of an effective image area E in a length direction of the developing roller 13. A length of the effective image area E is determined by considering a width of a recording medium P of an available maximum size. In general, the length of the effective image area E is slightly longer than the width of the recording medium P of an available maximum size. Accordingly, contamination of printing images by the developer contained in the discharged air may be reduced or prevented. The air outlet 130 may be provided only at one side of the effective image area E or at both sides of the effective image area E. In addition, a plurality of air outlets 130 may be provided at one side or both sides of the effective image area E. The number and locations of the air outlets 130 may be appropriately determined so as to maintain an appropriate level of an internal pressure of the developing chamber 210.

When the air outlet 130 and the air inlet 120 overlap each other in the length direction of the developing roller 13, turbulence may be generated due to the air discharged from the air outlet 130 encountering the air flowing to the air inlet 120. The turbulence may deteriorate scattering of toner. Considering this point, the air outlet 130 may be disposed such that the air outlet 130 does not overlap the air inlet 120 in the length direction of the developing roller 13.

A flue hole 140 is formed in the developing chamber 210. The flue hole 140 is connected to the air outlet 130 via a discharge path 150. The flue hole 140 may be formed in a wall 213 of the developing chamber 210 opposite the opening portion 211. The form of the flue hole 140 is not particularly limited.

When a trickle developing method is used, a trickle discharge outlet 193 may be provided to maintain a predetermined uniform amount of the developer in the developing chamber 210. The developing device 10 may also include first and second extension portions 191 and 192, and a developer inlet 194. A further description of these elements will be provided below.

FIGS. 5*a* through 5*d* illustrate a shape of a flue hole according to examples.

Referring to FIG. 5*a*, the flue hole 140 may have a shape extending in the length direction of the developing roller 13. Referring to FIGS. 5*c* and 5*d*, one flue hole 140 or a plurality of flue holes 140 may be formed in a center portion of the developing chamber 210. Referring to FIG. 5*c*, the flue hole 140 may be formed at two sides in the length direction of the developing roller 13. The shape of the flue hole 140 illustrated in FIGS. 5*a* through 5*d* is merely an example, and the shape, number, and location of the flue hole 140 may be appropriately determined. For example, the shape, number, and location of the flue hole 140 may be appropriately determined so as to maintain an appropriate level of an internal pressure of the developing chamber 210.

The discharge path 150 may have various forms for connecting the flue hole 140 and the air outlet 130. The discharge path 150 may be disposed, for example, between the wall 213 of the developing chamber 210 and an outerwall 115 of the developing casing 110.

The discharge path 150 may have a shape appropriate for reducing a pressure of the air discharged from the developing chamber 210.

FIG. 6 corresponds to a cross-sectional view of FIG. 2 taken along a line A-A', illustrating a discharge path according to an example.

Referring to FIG. 6, the discharge path 150 has a structure whereby a proceeding direction of the discharged air may be converted into the opposite direction at least once, on a plane orthogonally intersecting with a rotational axis of the developing roller 13. For example, the discharge path 150 may have at least one "U"-shaped path 155. The discharge path 150 may include a first path 151 extending from the flue hole 140 and a second path 152 connected to the first path 151 via the "U"-shaped path 155 and extended in an opposite direction to the first path 151. The first path 151 and the second path 152 may be separated from each other through an internal wall 153. The first path 151 is a space between the wall 213 and the internal wall 153, and the second path 152 is a space between the internal wall 153 and the outerwall 115.

According to this configuration, while the air is discharged along the discharge path 150, the pressure of the air is reduced to thereby slow down a speed of the air discharged from the air outlet 130. Accordingly, an amount of the developer discharged with the air may be reduced. In addition, the developer discharged with the air may be filtered out through the internal wall 153 and the "U"-shaped path 155, thus the amount of the developer discharged along the air may be reduced. By installing a plurality of internal walls 153, a plurality of "U"-shaped paths 155 may be formed. A cross-sectional shape of the discharge path 150 and a shape, a size, and a number of the internal wall 153 may be appropriately determined so as to reduce a pressure and a speed of the air being discharged and to reduce the amount of discharged developer.

An internal pressure in the developing chamber 210 should be maintained appropriately. For example, a condition may be set such that the air is discharged when the internal pressure of the developing chamber 210 is at a predetermined level or higher. To this end, the developing device 10 may include at least one valve through which the discharge path 150 is opened or closed. The valve selectively opens or closes the discharge path 150 according to an air pressure in the developing chamber 210. For example, the valve may close the discharge path 150 when an internal pressure in the developing chamber 210 is lower than a predetermined level, and open the discharge path 150 when the internal pressure in the developing chamber 210 is equal to or higher than a predetermined level. For example, the valve may be formed of an elastic film that elastically blocks the discharge path 150, and that is pushed by the air discharged according to an amount of the internal pressure of the developing chamber 210 and elastically bent to thereby open the discharge path 150.

FIG. 7 is a cross-sectional view of a developing device including a discharge path having a valve, according to an example. FIG. 8 is a cross-sectional view of a developing device including an air outlet having a valve, according to an example.

Referring to FIG. 7, a valve 161 is mounted in the flue hole 140. The valve 161 may be, for example, an elastic film. The elastic film blocks the flue hole 140. When an air pressure in the developing chamber 210 reaches a predetermined level or a higher, the elastic film is elastically bent to open the flue hole 140. An amount of bending of the elastic film depends on the air pressure, and thus, the higher the air pressure, the more the elastic film is bent, thereby increasing an amount of opening of the flue hole 140. When the air pressure in the developing chamber 210 becomes lower than a predetermined level, the elastic film is restored to its original position through its elasticity, thereby blocking the flue hole 140. According to this configuration, an internal pressure in the developing chamber 210 may be maintained at a predetermined level. In addition, as the air is discharged only when the internal pressure in the developing chamber 210 is at a predetermined level or a higher level, the amount of discharged developer may be reduced compared to when the discharge path 150 is constantly open. Accordingly, contamination of the image forming apparatus or degradation of printing quality relating to this contamination may be addressed more effectively. In addition, as the developer discharged from the developing chamber 210 with the air is blocked by the elastic film, the amount of the developer being discharged may be reduced.

A mounting location of the valve is not particularly limited. For example, as illustrated in FIG. 7, a valve 162 may be mounted in the "U"-shaped path 155. The valve 162 may be an elastic film as described above. In addition, at least two valves may be mounted in the discharge path 150. For example, as illustrated in FIG. 7, a valve may be mounted in each of the flue hole 140 and the "U"-shaped path 155. In addition, as illustrated in FIG. 8, a valve 163 may be mounted in the air outlet 130. The valve 163 may be an elastic film as described above.

As described above, by providing the air outlet 130, a pressure in the developing chamber 210 may be reduced or maintained at a level less than a predetermined level so that an amount of scattering of the developer may be reduced and contamination inside and outside the image forming apparatus may be reduced or prevented. In particular, the higher a rotational speed of the developing roller 13 and the photo-sensitive drum 14, the greater the volume of air that flows into the developing chamber 210. Depending on conditions, this may abruptly raise the internal pressure in the developing chamber 210 and cause an increase in the amount of scattering of the developer. According to the developing device 10 of the present example, the air may be efficiently discharged to the outside to thereby effectively reduce or prevent an increase in the internal pressure in the developing chamber 210. Thus, the amount of scattering of the developer may be reduced. In addition, as the air outlet 130 is located outside the effective image forming area E, image contamination may be reduced or prevented.

FIG. 9 is a graph showing a result of determining a level of scattering of a developer according to a printing speed, according to an example.

Referring to FIG. 9, a level of scattering of the developer to the outside from the developing chamber 210 at different printing speeds was observed by visual inspection. The scattering level of the developer was divided into levels "0" through "12", wherein level "0" denotes the worst scattering level of the developer and level "12" denotes the least scattering level of the developer. As shown in FIG. 9, if the air outlet 130 is not included, the scattering level of the developer significantly worsens at higher printing speeds. However, according to the developing device 10 of the present example in which the air outlet 130 is included, even when a printing speed increases, the scattering level is maintained at an appropriate level of almost "9" or higher.

The air outlet 130 may also be applied to the developing device 10 in which a trickle method is used. In the trickle method, a predetermined amount of toner and carrier is supplied from the developer cartridge 20 and a remaining amount of a developer is discharged through the trickle discharge outlet 193 to maintain a predetermined uniform amount of the developer in the developing chamber 210. The first and second extension portions 191 and 192 (see FIG. 2) may respectively extend from the developing chamber 210 and the agitating chamber 220 in the length direction of the developing roller 13 and protrude from the developing casing 110. The trickle discharge outlet 193 may be provided in the first extension portion 191 or the second extension portion 192. The developer inlet 194, through which a developer flows into the developer cartridge 20, may be provided in one of the first and second extension portions 191 and 192 where the trickle discharge outlet 193 is not provided.

In the developing device 10 that uses a trickle method, if an internal pressure of the developing chamber 210 increases excessively, an excessive amount of developer is discharged through the trickle discharge outlet 193 so that an amount of the developer in the developing chamber 210 falls short of an appropriate level and image density may be lowered. According to the present example, as an internal pressure of the developing chamber 210 is maintained at an appropriate level via the air outlet 130, an amount of the residual developer discharged through the trickle discharge outlet 193 may be stabilized. Accordingly, as an amount of the developer in the developing chamber 210 is maintained at an appropriate level, even when a printing speed increases, image quality may be stably maintained.

FIG. 10 is a graph showing a result of determining an amount of a developer in a developing chamber according to a printing speed, according to an example. The result of FIG. 10 was obtained by measuring an amount of developer in the developing chamber 210 when the amount of the developer in the developing chamber 210 was stabilized while modifying a printing speed of the developing device 10 that uses a trickle method.

Referring to FIG. 10, when the air outlet 130 is not included, the amount of the developer in the developing chamber 210 is reduced as the printing speed increases, whereas according to the developing device 10 of the present example, even when the printing speed increases, the amount of the developer in the developing chamber 210 is maintained at an appropriate level almost constantly.

Hereinafter, a relationship between an effective cleaning area of a cleaning member that cleans a surface of an opposite member that the air outlet 130 faces and an installation location of the air outlet 130 will be described. The effective cleaning area may refer to, for example, an area of contact between the opposite member and the cleaning member.

For example, the opposite member may be the photosensitive drum 14. As illustrated in FIG. 4, the air outlet 130 may face the photosensitive drum 14. That is, the air discharged through the air outlet 130 may face a surface of the photosensitive drum 14. The developer contained in the air may adhere to the surface of the photosensitive drum 14.

FIGS. 11*a* through 11*c* are schematic views of an installation location of an air outlet according to an example.

Referring to FIG. 11*a*, in order for a developer adhered to a surface of the photosensitive drum 14 to be removed using the cleaning member 17, the air outlet 130 may be located within an effective cleaning area E2 of the cleaning member 17 with respect to the length direction of the developing roller 13. That is, the air outlet 130 may be located outside the effective image area E and within the effective cleaning area E2. In an example, the air outlet 130 is located where it does not overlap with the air inlet 120. According to this configuration, even when the developer discharged due to being carried by the air discharged from the air outlet 130 adheres to a surface of the photosensitive drum 14, the developer may be cleaned using the cleaning member 17, and thus, a degradation of an image quality due to scattered developer may be reduced or prevented.

Referring to FIG. 11*b*, the air outlet 130 may be located outside an effective cleaning area E2 of the cleaning member 17 with respect to the length direction of the developing roller 13. In this case, a shape of the air outlet 130 may be set such that the discharged air faces an inner portion of the effective cleaning area E2 of the cleaning member 17. For example, the discharge path 150 adjacent to the air outlet 130 may have a shape that is inwardly inclined from an outerside in the length direction of the air outlet 130. According to this configuration, the developer discharged due to being carried in the air discharged from the air outlet 130 may adhere to a surface of the photosensitive drum 14 and cleaned using the cleaning member 17 within the effective cleaning area E2 of the cleaning member 17, and thus, degradation of an image quality due to scattered developer may be reduced or prevented.

Referring to FIG. 11*c*, the air outlet 130 may be located outside an effective cleaning area E2 of the cleaning member 17 with respect to the length direction of the developing roller 13. In this case, the developing device 10 may further include an auxiliary cleaning member 17-1 located outside the cleaning member 17. The auxiliary cleaning member 17-1 may contact a surface of the photosensitive drum 14 outside the effective cleaning area E2 of the cleaning member 17 to remove foreign substances. The auxiliary cleaning member 17-1 may be, for example, an elastic blade such as rubber, a fur-brush, or a foam member such as sponge that contacts a surface of the photosensitive drum 14. According to this configuration, even if the developer discharged due to being carried by the air discharged from the cleaning member 17 adheres to a surface of the photosensitive drum 14 that is outside the effective cleaning area E2 of the cleaning member 17, the developer may be cleaned using the auxiliary cleaning member 17-1, and thus, degradation of an image quality due to scattered developer may be reduced or prevented. The auxiliary cleaning member 17-1 may also be applied to the example of FIG. 11*b*.

The air outlet 130 may also face another direction besides the direction facing the photosensitive drum 14. For example, the opposite member may be the intermediate transfer belt 60.

FIG. 12 is a cross-sectional view of a developing device according to an example.

Referring to FIG. 12, the air outlet 130 faces the intermediate transfer belt 60. The location relationship between the effective cleaning area E2 of the cleaning member 17 and the air outlet 130 described above with reference to FIGS. 11A through 11C may also apply to a location relationship between an effective cleaning area of the cleaning member 75 and the air outlet 130. In this case, in the examples of FIGS. 11*a* through 11*c*, the photosensitive drum 14 may be regarded as the intermediate transfer belt 60, and the cleaning member 17 may be regarded as the cleaning member 75, and the effective cleaning area E2 may be regarded as an effective cleaning area E3, and the auxiliary cleaning member 17-1 may be regarded as an auxiliary cleaning member 75-1.

Referring to FIG. 11*a*, in order that the developer adhered to a surface of the intermediate transfer belt 60 is removed using the cleaning member 75, the air outlet 130 may be located within the effective cleaning area E3 of the cleaning member 75 with respect to a length direction of the developing roller 13. That is, the air outlet 130 may be located outside the effective image area E and within the effective cleaning area E3. In an example, the air outlet 130 is located at a location where it does not overlap the air inlet 120. According to this configuration, even when a developer discharged due to being carried by the air discharged from the air outlet 130 adheres to a surface of the intermediate transfer belt 60, the developer may be cleaned using the cleaning member 75, and thus, degradation of an image quality due to scattered developer may be reduced or prevented.

Referring to FIG. 11*b*, the air outlet 130 may be located outside the effective cleaning area E3 of the cleaning member 75 with respect to the length direction of the developing roller 13. In this case, the air outlet 130 may be set such that the discharged air faces an inner portion of the effective cleaning area E3 of the cleaning member 75. For example, the discharge path 150 adjacent to the air outlet 130 may have a shape that is inwardly inclined from an outer side in the length direction of the developing roller 13. According to this configuration, the developer discharged due to being carried by the air discharged from the air outlet 130 may adhere to a surface of the intermediate transfer belt 60 and cleaned using the cleaning member 75 within the effective cleaning area E3 of the cleaning member 75, and thus, degradation of an image quality due to scattered developer may be reduced or prevented.

Referring to FIG. 11*c*, the air outlet 130 may be located outside the effective cleaning area E3 of the cleaning member 75 with respect to the length direction of the developing roller 13. In this case, the developing device 10 may further include an auxiliary cleaning member 75-1 located outside the cleaning member 75. The auxiliary cleaning member 75-1 may contact a surface of the intermediate transfer belt 60 outside the effective cleaning area E3 to remove foreign substances. The auxiliary cleaning member 75-1 may be, for example, an elastic blade such as rubber, a furbrush, or a foam member such as a sponge that contacts a surface of the intermediate transfer belt 60. According to this configuration, even when the developer discharged due to being carried by the air discharged from the air outlet 130 adheres to a surface of the intermediate transfer belt 60 outside the effective cleaning area E3 of the cleaning member 75, the developer may be cleaned using the auxiliary cleaning member 75-1, and thus, degradation of an image quality due to scattered developer may be reduced or prevented. The auxiliary cleaning member 75-1 may also be applied to the example of FIG. 11*b*.

It should be understood that examples described herein should be considered in a descriptive sense only and not for purposes of limitation. Descriptions of features or aspects within each example should typically be considered as available for other similar features or aspects in other examples.

While one or more examples have been described with reference to the figures, it will be understood by those of ordinary skill in the art that various changes in form and details may be made therein without departing from the spirit and scope as defined by the following claims.

The invention claimed is:

1. A developing device comprising:

a developing chamber having an opening portion;

a developing roller mounted in the developing chamber, wherein the developing roller is partially exposed to an environment outside the developing chamber through the opening portion;

an air inlet between an upstream boundary of the opening portion in a rotational direction of the developing roller and an outer circumference of the developing roller, wherein air is to pass into the developing chamber through the air inlet; and an air outlet formed near the upstream boundary of the opening portion and communicatively connected to the developing chamber so as to discharge air from the developing chamber, wherein the air outlet is located outside an effective image area in a length direction of the developing roller, and the air outlet does not overlap with the air inlet in the length direction of the developing roller.

2. The developing device of claim 1, further comprising:

a flue hole in a wall of the developing chamber facing the opening portion, wherein the flue hole is connected to the air outlet through a discharge path.

3. The developing device of claim 2, wherein the discharge path comprises a path having a U-shape in which a direction of an air flow is reversed.

4. The developing device of claim 2, further comprising a valve to open or close the discharge path.

5. The developing device of claim 1, further comprising:

a photosensitive body on which an electrostatic latent image is to be formed, the photosensitive body facing the developing roller; and a cleaning member to clean a surface of the photosensitive body, wherein the air outlet faces the photosensitive body.

6. The developing device of claim 5, wherein the air outlet is located within an effective cleaning area of the cleaning member in the length direction of the developing roller.

7. The developing device of claim 5, wherein the air outlet is located outside an effective cleaning area of the cleaning member in the length direction of the developing roller, and wherein air discharged from the air outlet faces the effective cleaning area.

8. The developing device of claim 5, wherein the air outlet is located outside an effective cleaning area of the cleaning member in the length direction of the developing roller, and wherein the developing device further comprises an auxiliary cleaning member to clean the surface of the photosensitive body outside the effective cleaning area of the cleaning member.

9. The developing device of claim 1, further comprising a photosensitive body on which an electrostatic latent image is to be formed, the photosensitive body facing the developing roller, wherein the air outlet faces other than the photosensitive body.

10. The developing device of claim 1, wherein when the developing roller is rotated in the rotational direction air is drawn into the developing chamber through the air inlet.

11. The developing device of claim 1, wherein the air outlet is located above the upstream boundary of the opening portion and is adjacent the upstream boundary.

12. A developing device comprising:

a developing chamber having an opening portion;

a developing roller mounted in the developing chamber, wherein the developing roller is partially exposed to an environment outside the developing chamber through the opening portion;

an air inlet between an upstream boundary of the opening portion in a rotational direction of the developing roller and an outer circumference of the developing roller, wherein air is to pass into the developing chamber through the air inlet;

an air outlet formed near the upstream boundary of the opening portion and communicatively connected to the developing chamber so as to discharge air from the developing chamber, wherein the air outlet is located outside an effective image area in a length direction of the developing roller;

a flue hole in a wall of the developing chamber facing the opening portion, wherein the flue hole is connected to the air outlet through a discharge path; and a valve to open or close the discharge path, wherein the valve comprises an elastic film configured to elastically block the discharge path, and the elastic film is pushed by air discharged according to an amount of a pressure in the developing chamber to elastically bend the elastic film so as to open the discharge path.

13. The developing device of claim 12, wherein when the developing roller is rotated in the rotational direction air is drawn into the developing chamber through the air inlet.

14. The developing device of claim 12, wherein the air outlet is located above the upstream boundary of the opening portion and is adjacent the upstream boundary.

15. An electrophotographic image forming apparatus comprising:

a developing chamber having an opening portion;

a developing roller mounted in the developing chamber, wherein the developing roller is partially exposed to an environment outside the developing chamber through the opening portion;

an air inlet between an upstream boundary of the opening portion in a rotational direction of the developing roller and an outer circumference of the developing roller, wherein air is to pass into the developing chamber through the air inlet;

an air outlet formed near the upstream boundary of the opening portion and communicatively connected to the developing chamber so as to discharge air in the developing chamber, wherein the air outlet is located outside an effective image area in a length direction of the developing roller, and the air outlet does not overlap with the air inlet in the length direction of the developing roller;

a photosensitive body on which an electrostatic latent image is to be formed, the photosensitive body facing the developing roller;

a transfer device to transfer a toner image onto a recording medium; and a fixing device to fix the toner image on the recording medium, wherein the toner image is formed by supplying a developer to the electrostatic latent image formed on the photosensitive body.

16. The electrophotographic image forming apparatus of claim 15, wherein the transfer device comprises an intermediate transfer member to which the toner image is temporarily transferred, and wherein the air outlet is located within an effective cleaning area of a cleaning member that is to clean an opposite member, the opposite member comprising one of the photosensitive body and the intermediate transfer member.

17. The electrophotographic image forming apparatus of claim 15, wherein the transfer device comprises an intermediate transfer member to which the toner image is temporarily transferred, wherein the air outlet is located outside an effective cleaning area of a cleaning member that is to clean an opposite member, the opposite member comprising one of the photosensitive body and the intermediate transfer member, and wherein air discharged from the air outlet faces an inner portion of the effective cleaning area.

18. The electrophotographic image forming apparatus of claim 15, wherein the transfer device comprises an intermediate transfer member to which the toner image is temporarily transferred, wherein the air outlet is located outside an effective cleaning area of a cleaning member that is to clean an opposite member, the opposite member comprising one of the photosensitive body and the intermediate transfer member, and wherein the electrophotographic image forming apparatus comprises an auxiliary cleaning member to clean a surface of the opposite member outside the effective cleaning area.

19. The electrophotographic image forming apparatus of claim 15, wherein when the developing roller is rotated in the rotational direction air is drawn into the developing chamber through the air inlet.

20. The electrophotographic image forming apparatus of claim 15, wherein the air outlet is located above the upstream boundary of the opening portion and is adjacent the upstream boundary.

* * * * *